US010507959B2

(12) United States Patent
Kirsh

(10) Patent No.: US 10,507,959 B2
(45) **Date of Patent: *Dec. 17, 2019**

(54) CHILD RESISTANT SEALING SYSTEM

(71) Applicant: Quark Distribution, Inc., New York, NY (US)

(72) Inventor: Ross Kirsh, New York, NY (US)

(73) Assignee: QUARK DISTRIBUTION, INC.

( * ) Notice: Subject to any disclaimer, the term of this patent is extended or adjusted under 35 U.S.C. 154(b) by 0 days.

This patent is subject to a terminal disclaimer.

(21) Appl. No.: 16/351,996

(22) Filed: Mar. 13, 2019

(65) Prior Publication Data

US 2019/0210776 A1 Jul. 11, 2019

Related U.S. Application Data

(63) Continuation of application No. 15/992,914, filed on May 30, 2018, which is a continuation of application No. 15/855,004, filed on Dec. 27, 2017, now Pat. No. 10,011,404, which is a continuation of application No. 15/440,091, filed on Feb. 23, 2017, now Pat. No. 10,011,403.

(51) Int. Cl.

| | |
|---|---|
| ***B65D 50/00*** | (2006.01) |
| ***B65D 33/00*** | (2006.01) |
| ***B65D 33/25*** | (2006.01) |

(52) U.S. Cl.

CPC ..... *B65D 50/00* (2013.01); *B65D 33/007* (2013.01); *B65D 33/2566* (2013.01); *B65D 2215/08* (2013.01)

(58) Field of Classification Search

CPC .. B65D 50/00; B65D 33/007; B65D 33/2566; B65D 2215/08

USPC ..... 383/63, 65

See application file for complete search history.

(56) References Cited

U.S. PATENT DOCUMENTS

| | | | |
|---|---|---|---|
| 2,916,197 | A | 12/1959 | Detrie et al. |
| 4,410,130 | A | 10/1983 | Herrington |

(Continued)

FOREIGN PATENT DOCUMENTS

| | | |
|---|---|---|
| EP | 3015395 | 5/2016 |
| JP | 2017210258 | 11/2017 |

OTHER PUBLICATIONS

Patent Cooperation Treaty (PCT) International Search Report, dated Jul. 3, 2018, ISA/US, USPTO.

*Primary Examiner* — Jes F Pascua

(74) *Attorney, Agent, or Firm* — Antonio Papageorgiou; Meister Seelig & Fein LLP

(57) ABSTRACT

The present application provides a container that includes: a first layer of sheet material forming the first side of the container and at least a second and third layer of sheet material forming the second side of the container, a pair of closure strips extending along the opening of the container, each of the closure strips having at least one of a male and a female linear interlocking strip. A first of the pair of closure strips includes: an extension above and an extension below the respective linear interlocking strip, and a second of the pair of closure strips comprising an extension below the respective linear interlocking strip. The linear interlocking strips configured to be released from each other by pulling the extensions below the linear interlocking strips apart using a pair of flaps extending from the closure strip extensions.

19 Claims, 5 Drawing Sheets

(56) References Cited

U.S. PATENT DOCUMENTS

| | | | |
|---|---|---|---|
| 4,926,526 | A | 5/1990 | Brown et al. |
| 5,007,143 | A | 4/1991 | Herrington |
| RE33,674 | E | 8/1991 | Uramoto |
| 5,272,794 | A | 12/1993 | Hamatani |
| 5,711,609 | A | 1/1998 | Simonsen |
| 5,931,582 | A | 8/1999 | Nichols |
| 6,039,182 | A | 3/2000 | Light |
| 6,149,302 | A | 11/2000 | Taheri |
| 6,376,035 | B1 | 4/2002 | Dobreski et al. |
| 6,385,818 | B1 | 5/2002 | Savicki |
| 6,733,178 | B2 | 5/2004 | Bois |
| 7,029,178 | B2 | 4/2006 | Gzybowski |
| 7,316,101 | B1 | 1/2008 | Nguyen et al. |
| 7,494,280 | B2 | 2/2009 | Gzybowski |
| 7,506,417 | B2 | 3/2009 | Yoneoka |
| 8,118,489 | B2 | 2/2012 | Waldron et al. |
| 8,893,356 | B2 | 11/2014 | Ozaki et al. |
| 9,011,003 | B2 | 4/2015 | Pawloski |
| 9,022,003 | B2 | 5/2015 | Grover, Jr. et al. |
| 9,284,097 | B2 | 3/2016 | Heckman |
| 9,573,730 | B2 | 2/2017 | Heckman |
| 9,624,004 | B2 | 4/2017 | Kent et al. |
| 9,969,534 | B2 | 5/2018 | Kent et al. |
| 10,005,592 | B2 | 6/2018 | Takigawa |
| 1,002,982 | A1 | 7/2018 | Petkovsek |
| 10,011,403 | B1 * | 7/2018 | Kirsh ..... B65D 50/00 |
| 10,011,404 | B1 * | 7/2018 | Kirsh ..... B65D 50/00 |
| 10,093,458 | B2 | 10/2018 | Stave |
| 10,189,607 | B2 | 1/2019 | Tseng et al. |
| 2003/0014848 | A1 | 1/2003 | Larue et al. |
| 2004/0161169 | A1 | 8/2004 | Fenzl et al. |
| 2007/0183692 | A1 * | 8/2007 | Pawloski ..... B65D 33/2508 383/61.2 |
| 2014/0161374 | A1 | 6/2014 | Septien Rojas et al. |
| 2014/0270586 | A1 | 9/2014 | Petkovsek |
| 2014/0311101 | A1 | 10/2014 | Petkovsek et al. |
| 2014/0311102 | A1 | 10/2014 | Petkovsek et al. |
| 2016/0088906 | A1 | 3/2016 | Jin |
| 2016/0101904 | A1 | 4/2016 | Takigawa |
| 2016/0122087 | A1 | 5/2016 | Takigawa |
| 2017/0190476 | A1 | 7/2017 | Goto et al. |
| 2017/0217650 | A1 | 8/2017 | Steele |
| 2018/0118414 | A1 | 5/2018 | Martial |
| 2018/0312301 | A1 | 11/2018 | Martial |
| 2018/0312302 | A1 | 11/2018 | Septien Rojas |
| 2018/0319546 | A1 | 11/2018 | Liu |

* cited by examiner

CHILD RESISTANT SEALING SYSTEM

BACKGROUND OF THE INVENTION

The present application relates generally to child resistant sealing systems for containers, such as bags and the like.

A variety of products exist for containing, storing, and/or transporting substances. Flexible, e.g., plastic, bags, especially those with sealable and resealable openings, are particularly useful products that are widely available. Sealing systems for resealable plastic bags often include interlocking structures on opposing sides of a plastic bag opening, which can be coupled together by pressing them together, or using a slider coupled to the interlocking structures as described, for example, in U.S. Pat. No. 7,029,178. These systems, however, are easily opened and therefore not child resistant, which limits their use with regard to medicines and other substances that can potentially be hazardous when not used properly. Accordingly, there is a need for sealing systems for bags that are resistant to being opened easily, particularly by children.

SUMMARY OF THE INVENTION

In one aspect, the present application provides a container having a top end with an opening therein and a bottom end opposite the top end, and at least first and second sides between the top and bottom ends of the bag, the container includes: a first layer of sheet material forming the first side of the container and at least a second and third layer of sheet material forming the second side of the container, a pair of closure strips extending along the opening of the container, each of the closure strips having at least one of a male and a female linear interlocking strip. A first of the pair of closure strips includes: an extension above and an extension below the respective linear interlocking strip, and a second of the pair of closure strips comprising an extension below the respective linear interlocking strip. The linear interlocking strips configured to be released from each other by pulling the extensions below the linear interlocking strips apart, where the first layer of sheet material is attached to the first of the pair of closure strip at the extension below the respective linear interlocking strip therewith forming a first upward extending flap, the second layer of sheet material is attached to the second of the pair of closure strip at the extension below the respective linear interlocking strip therewith forming a second upward extending flap, and the third layer of sheet material is attached to the second of the pair of closure strips at the extension above the respective linear interlocking strip therewith forming a third upward extending flap, the container therewith capable of being opened by pulling the first and second flaps apart.

In at least one embodiment, at least one of the first, second, and third layers extends above the linear interlocking strip between about 0.5 inches to about 2.0 inches.

In at least one embodiment, the second flap extends upward to about a bottom of the third layer.

In at least one embodiment, the linear interlocking strips are configured so that pulling apart any of the flaps other than the first and second flaps prevents the interlocking strips from being released from each other.

In at least one embodiment, the linear interlocking strips are configured so that pulling the first and third flaps will not allow the interlocking linear strips to be released from each other.

In at least one embodiment, the closures strips comprise a first and second set of interlocking linear strips.

In at least one embodiment, a first set of interlocking strips comprise a male interlocking strip having a barb extending therefrom and a female interlocking strip having a hook shaped leg, the barb and hook shaped leg operable to engage each other in a sealed state and releasable by rotating the female interlocking strip relative to the male interlocking strip to disengage the barb from the hook shaped leg.

In at least one embodiment, the female strip comprises a straight leg.

In at least one embodiment, the hook shaped leg is located upward from the straight leg.

In at least one embodiment, the closure strips comprise a second set of interlocking strips.

In at least one embodiment, the second set of interlocking strips is located below the first set of interlocking strips.

In at least one embodiment, the second set of interlocking strips have a cross section that is symmetrical laterally.

In at least one embodiment, the closure strips each comprise a male and a female interlocking strip.

In at least one embodiment, pulling the first and second flaps causes the second set of interlocking strips to disengage from each other, followed by the first set of interlocking strips.

In at least one embodiment, pulling the first and third flaps causes the interlocking strips to work against being pulled apart.

In another aspect, the present application provides a container having a top end with an opening therein and a bottom end opposite the top end, and at least first and second sides between the top and bottom ends of the bag, the container includes: a first layer of sheet material forming the first side of the container and at least a second and third layer of sheet material forming the second side of the container, a pair of closure strips extending along the opening of the container, each of the closure strips having at least one of a male and a female linear interlocking strip. A first of the pair of closure strips further includes: an extension above and an extension below the respective linear interlocking strip, and a second of the pair of closure strips comprising an extension below the respective linear interlocking strip. The linear interlocking strips are configured to be released from each other by pulling the extensions below the linear interlocking strips apart, where the first layer of sheet material is attached to the first of the pair of closure strip at the extension below the respective linear interlocking strip therewith forming a first upward extending flap, the second layer of sheet material is attached to the second of the pair of closure strip at the extension below the respective linear interlocking strip therewith forming a second upward extending flap, and the third layer of sheet material is attached to the second of the pair of closure strips at the extension above the respective linear interlocking strip therewith forming a third upward extending flap, the container therewith capable of being opened by pulling the first and second flaps apart, whereas pulling the first and third flaps causes the interlocking strips to work against opening of the container.

In at least one embodiment, a first set of interlocking strips includes a male interlocking strip having a barb extending therefrom and a female interlocking strip having a hook shaped leg, the barb and hook shaped leg operable to engage each other in a sealed state and releasable by rotating the female interlocking strip relative to the male interlocking strip to disengage the barb from the hook shaped leg.

In at least one embodiment, the hook shaped leg is located upward from the straight leg.

In at least one embodiment, the closure strips comprise a second set of interlocking strips located below the first set of interlocking strips.

In at least one embodiment, pulling the first and second flaps causes the second set of interlocking strips to disengage from each other, followed by the first set of interlocking strips.

Additional aspects of the present invention will be apparent in view of the description which follows.

DETAILED DESCRIPTION OF THE INVENTION

The present application generally provides a resealable child resistant closure system for bags and other containers. For the purpose of this application, the following conventions will apply: vertical relative to the bag shall refer to a direction from a top of the bag to the bottom of the bag, where top shall be considered the location of the opening therein; lower shall refer to a direction toward the bottom and higher shall be a direction toward the top of the bag; lateral or horizontal shall refer to a direction from side to side, e.g., essentially orthogonal to the vertical direction.

Figure 1:
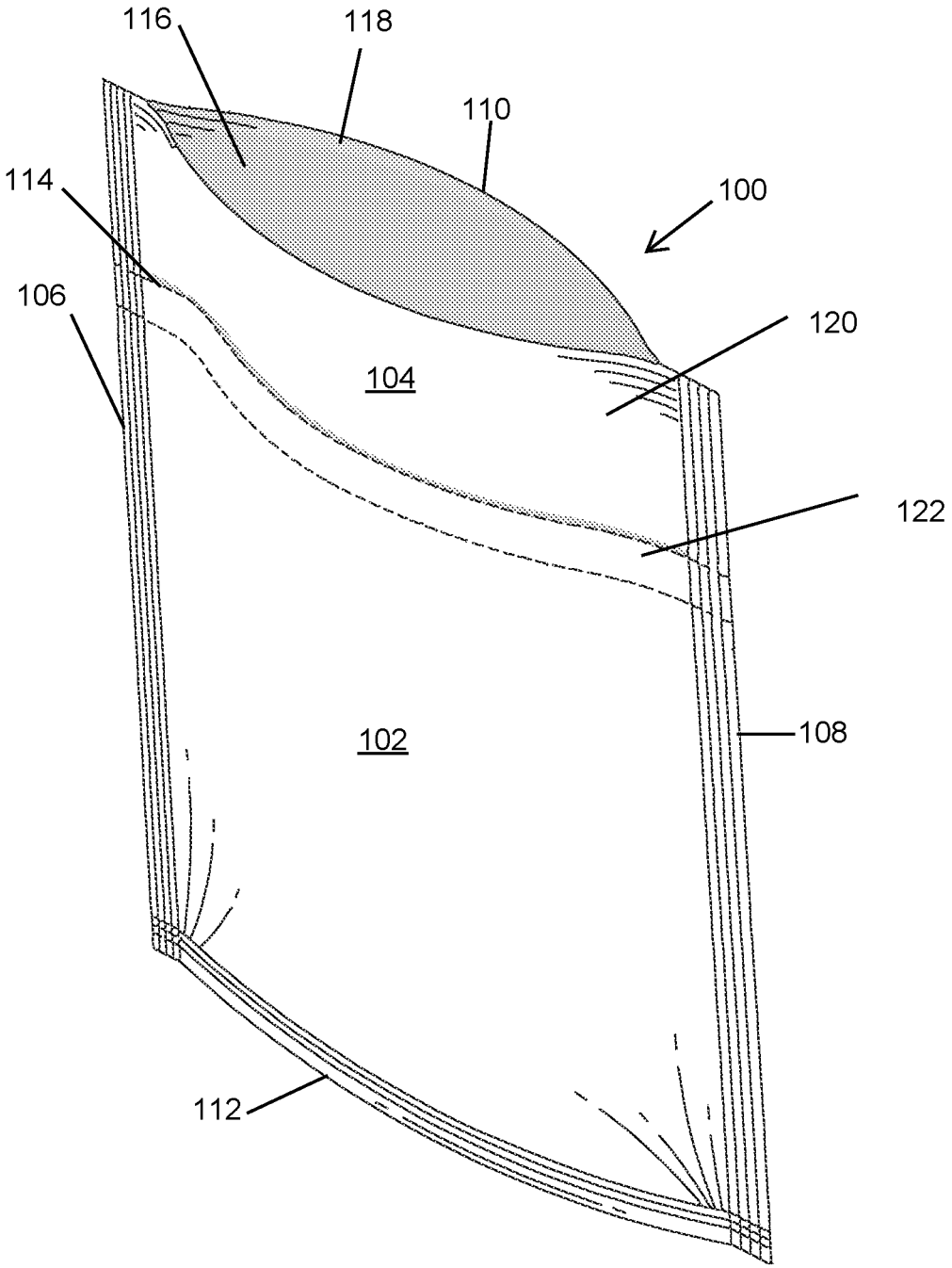
FIG. 1 is a perspective view of a bag with a child resistant sealing system according to at least one embodiment of the systems disclosed herein showing an opening therein.

Referring to FIG. 1, a bag 100 with a resealable child resistant closure system according to at least one embodiment of the systems disclosed herein includes a top end with an opening therein 116, and a bottom end 112 opposite the top end. The bag 100 preferably includes a plurality of sides 106, 108 laterally opposed to each other. The sides 106, 108 and bottom end 112 generally form the perimeter of the bag 100. Although the bag is shown as a square or rectangle, it is understood that the bag can be any shape.

The bag 100 itself may be formed from at least three layers of sheet materials, including a first full layer 110 that forms one side of the bag 100 and a plurality of partial (abutting or overlapping) layers 102, 104 that forms the opposite side of the bag 100. For the purpose of this application, layers 102, 110 may be a single continuous sheet folded to form a pair of opposing layers 102, 110. The layers 102, 104, and 110 preferably have a flap each, e.g., a pair of major flaps 118, 120, and at least one intermediate flap, that extend laterally across the bag, as shown. The perimeter of the sheets may be coupled, e.g., heat sealed, to form the closed structure of the bag 100. The bag 100 may be formed from various materials, including plastic and/or thermoplastic films, such as but not limited to polyethylene, polypropylene, etc.

The opening 116 in the top end of the bag 100 is preferably resealable with a directional closure system, as discussed herein. The closure system is preferably a closure strip assembly 300 that is attached, e.g., heat sealed, to the opposing sides 102, 104 and 110 of the bag 100, as shown in the accompanying figures. Moreover, the lateral slit 114 does not provide access to the inside of the bag 100, as also shown in the accompanying figures.

Figure 2:
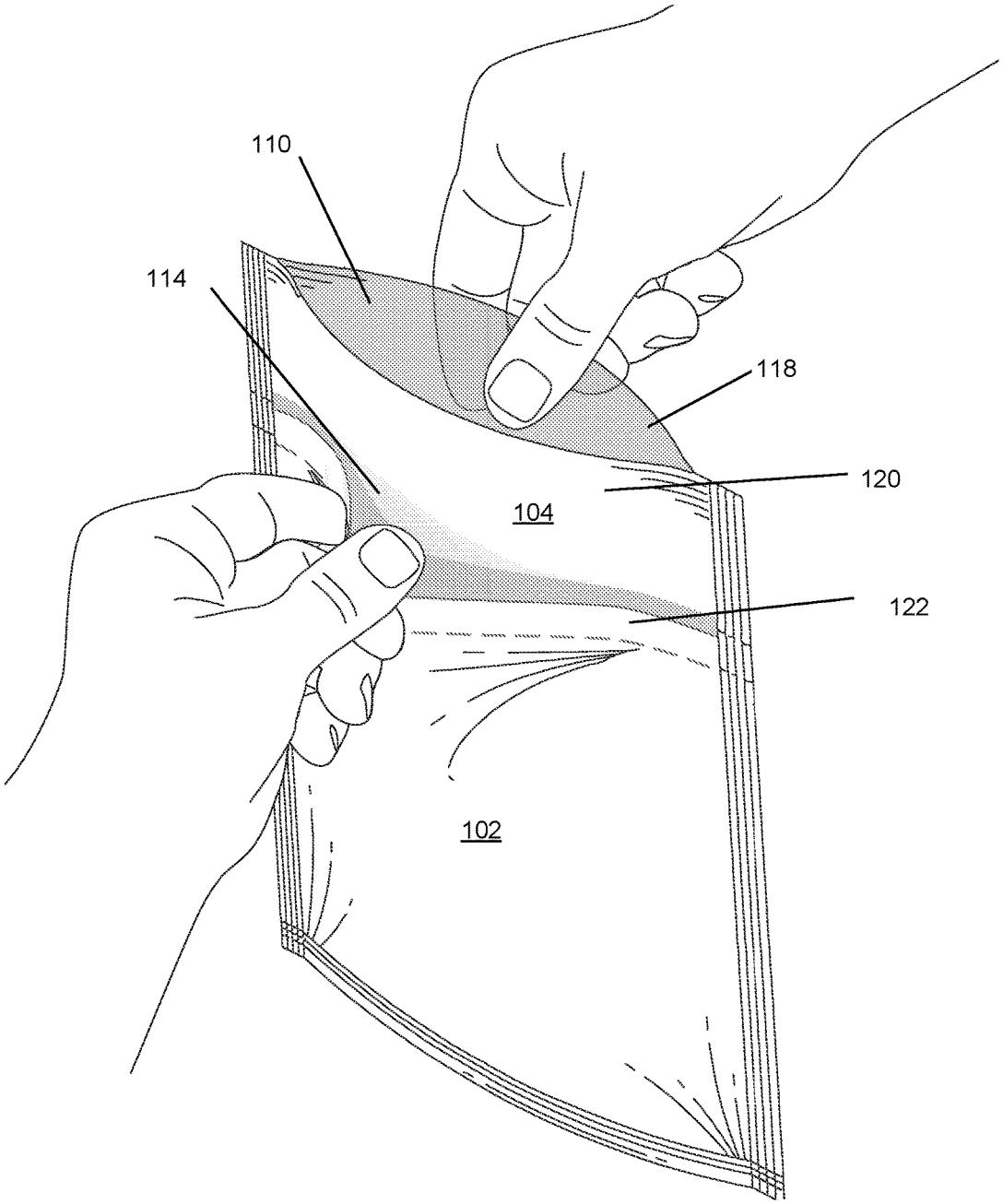
FIG. 2 is a perspective view of a bag with a bag with a child resistant sealing system according to at least one embodiment of the systems disclosed herein showing a user grasping respective sides of the bag to be opened.

Referring to FIG. 2, the directional closure system is preferably installed on the bag 100 so that the bag 100 is opened by pulling on intermediate the flap 122 and the major flap 118 associated with the opposite side 110 of the bag, as will be explained in greater detail below. Pulling on major flaps 118 and 120 will preferably not allow the bag to open. The term directional refers to the ease of the closure system from opening either from the top or the bottom of the closure system. In a preferred embodiment, the closure system is installed in the opening 116 so that it can only be opened by pulling the closure system at points below the interlocking elements of the closure (directional from below), as discussed further below. In this regard, attempts to pull the closure from the top or above the interlocking elements will be met with greater resistance.

Figure 3:
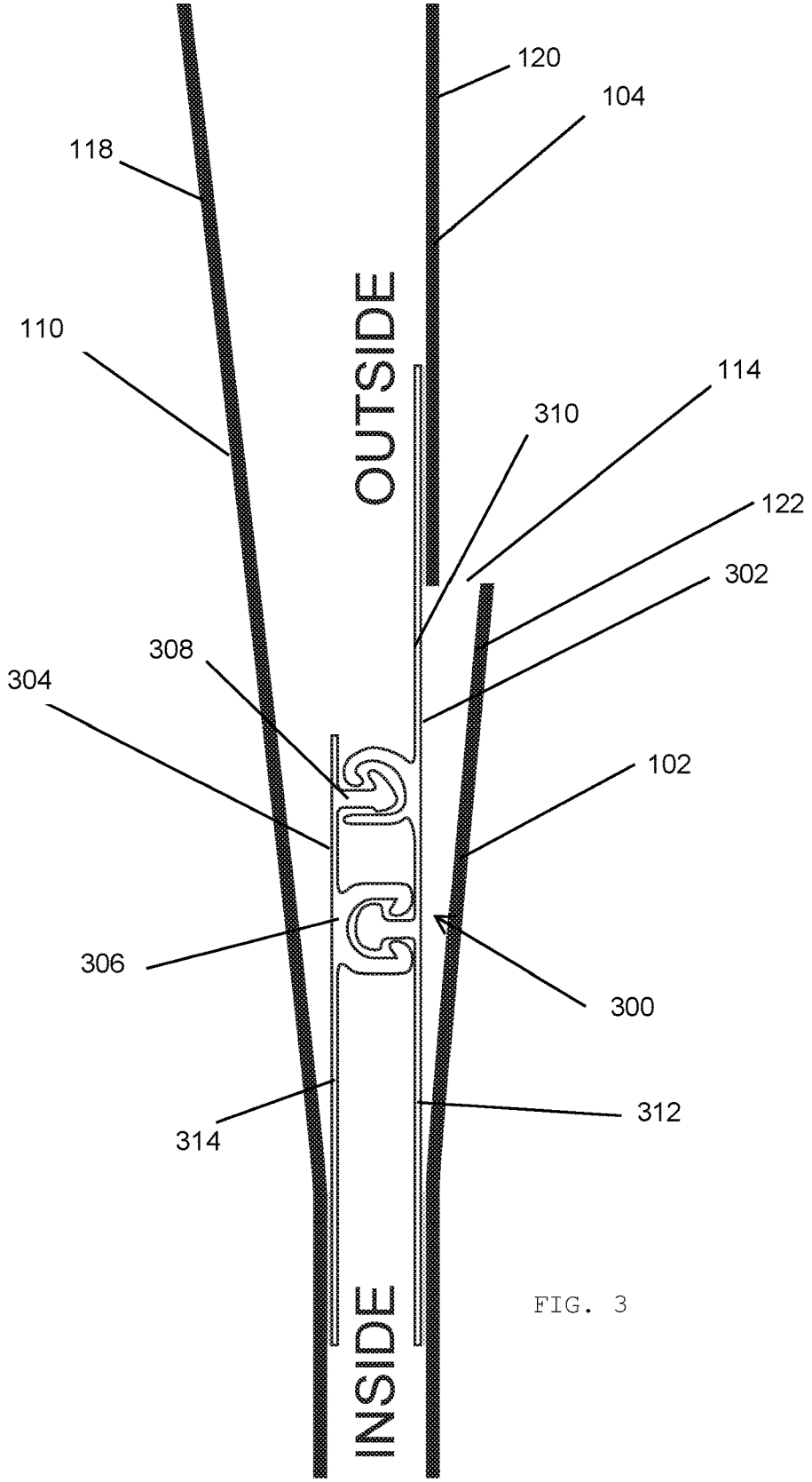
FIG. 3 is a cross section of a child resistant sealing system according to at least one embodiment of the systems disclosed herein.

Referring to FIG. 3, a cross section of the closure assembly 300 is shown at the opening 116 of the bag 100. The closure assembly preferably includes a pair of lateral strips 302, 304 that extend along the opening 116 of the bag 100. Each of the strips 302, 304 has at least one of a male and a female interlocking strip 306, 308. Each of the strips 302, 304 has a vertical height measured in a direction between the top and bottom of the bag 100. One of the strips 302 is preferably taller than the other strip 304. That is, only one of the strips 302 extends substantially above (e.g., about 0.5 inches) the male/female interlocking linear strips 306/308, as shown. In this regard, the closure assembly 300 includes one top extension 310 (above the interlocking linear strips) and two bottom extensions 312, 314 (below the interlocking linear strips). The closure system 300 is preferably installed in the opening so as to be directional from below the interlocking linear strips 306, 308. In this regard, the layers 102, 110 are coupled to the closure system 300 at the extensions below 312, 314 the interlocking linear strips 306, 308. The layer 104 is preferably attached to the extension above 310 the interlocking linear strips 306/308. The layers 102, 104, 110 preferably extend substantially above the attachment point (e.g., about 0.5 inches to about 2.0 inches) to provide the flaps 118, 120, 122 associated with each of the layers 102, 104, 110.

The interlocking linear strips 306, 308 preferably include at least one male strip and at least one female strip, or preferably a plurality of each to form two sets of interlocking linear strips. At least one of the sets of linear strips 308 include asymmetrical male and female strips. That is, the female strip has a straight leg and a hook shaped leg located above the straight leg. The male strip includes a barb that engages or otherwise catches the hook shaped leg. In this regard, this asymmetrical pair of strips can be removed by rotating the female strip counter clockwise relative to the male strip. The interlocking linear strips 306, 308 may include a second set of symmetrical male and female strips as shown. These preferably do not include interlocking barbs so as to be releasable without rotation of the parts relative to each other.

Figure 4:
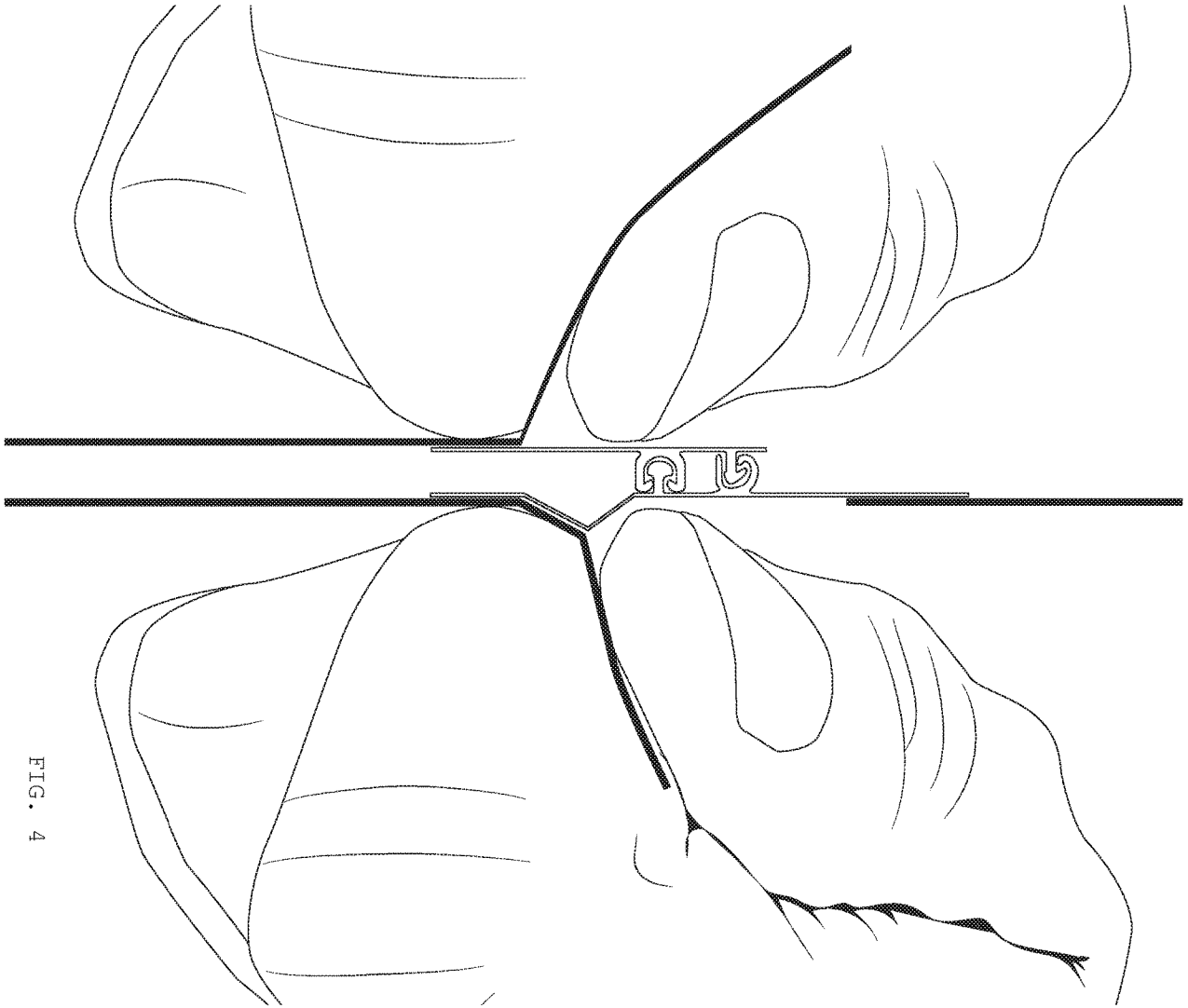
FIG. 4 is the cross section of a child resistant sealing system according to at least one embodiment of the systems disclosed herein grasped by a user for opening.
Figure 5:
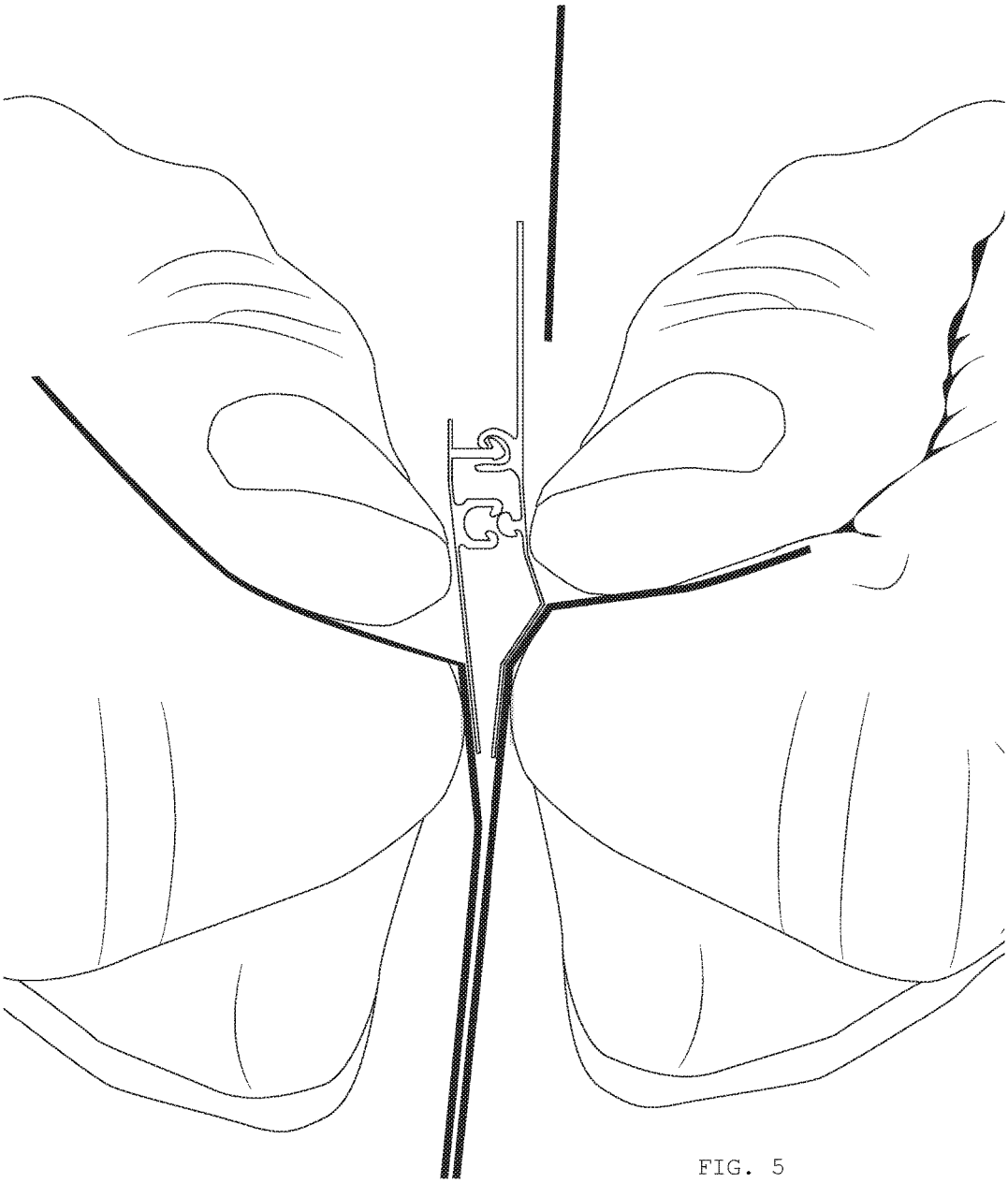
FIG. 5 a child resistant sealing system according to at least one embodiment of the systems disclosed herein shown in a partially opened state.

Referring to FIG. 4, the closure system is shown in a sealed state. As can be seen, a top set of interlocking strips are interconnected so that the barb of the male strip engages the hook of the female strip. The bottom set of interlocking strips interconnect by simply fitting the male to the female strips. Although the male and female strips are shown on opposites sides, it is understood that these may be disposed on the same side of the layers. To release the closure assembly, a user grabs the flaps coupled to the extensions below the interlocking layers, i.e., the flap associated with the lower partial layer 102 and the flap associated with the full layer 110. As seen on FIG. 4, following through results in the lower set of interlocking strips being released from each other from tension alone. Following through further results in the female strip of the top interlocking strip rotating counter clockwise relative to the male strip, which causes the hook and barb do disengage from each other. As can be appreciated, pulling the flaps associated with the upper partial layer 104 results in a clockwise rotation of the upper female strip relative to the male strip, therewith preventing or otherwise acting against the interlocking strips from being pulled apart.

While the foregoing invention has been described in some detail for purposes of clarity and understanding, it will be appreciated by one skilled in the art, from a reading of the disclosure, that various changes in form and detail can be made without departing from the true scope of the invention.

What is claimed is:

1. A container having a top end with an opening therein and a bottom end opposite the top end, and at least first and second sides between the top and bottom ends of the container, the container comprising:

a first layer of sheet material forming the first side of the container and at least a second and third layer of sheet material forming the second side of the container, a closure strip assembly extending along the opening of the container, the closure strip assembly comprising a first set of interlocking strip halves having at least a first half and a second half, the closure strip assembly further comprising:

an extension above and an extension below the first half, and an extension below the second half, wherein the second layer of sheet material is attached to the closure strip assembly at the extension below the one of the first half therewith forming a first upward extending flap, the first layer of sheet material is attached to the closure strip assembly at the extension below the second half therewith forming a second upward extending flap, and the third layer of sheet material is attached to the closure strip assembly at the extension above the first half therewith forming a third upward extending flap, wherein the second flap extends upward of the third layer to form a lateral slit between the second and third layers of sheet material that does not provide access to the inside of the container, wherein the first set of interlocking strip halves are configured such that when engaged with each other pulling apart any of the flaps other than the first and second flaps resists the first set of interlocking strip halves from being released from each other, the container is therewith capable of being opened at the closure strip assembly by pulling the first and second flaps apart.

2. The container of claim 1, wherein at least one of the first, second, and third layers extends above the first set of interlocking strip halves between about 0.5 inches to about 2.0 inches.

3. The container of claim 1, wherein the closures strip assembly comprises a second set of interlocking strip halves.

4. The container of claim 1, wherein the first set of interlocking strip halves comprises a male interlocking strip having a barb extending therefrom and a female interlocking strip having a hook shaped leg, the barb and hook shaped leg operable to engage each other in a sealed state and releasable by rotating the female interlocking strip relative to the male interlocking strip to disengage the barb from the hook shaped leg.

5. The container of claim 4, wherein the female strip comprises a straight leg.

6. The container of claim 5, wherein the hook shaped leg is located upward from the straight leg.

7. The container of claim 6, wherein the closure strip assembly comprises a second set of interlocking strip halves.

8. The container of claim 7, wherein the second set of interlocking strip halves is located below the first set of interlocking strip halves.

9. The container of claim 8, wherein the second set of interlocking strip halves have a cross section that is symmetrical laterally.

10. The container of claim 7, wherein second set of interlocking strip halves comprises a male and a female interlocking strip.

11. The container of claim 7, wherein pulling the first and second flaps causes the second set of interlocking strip halves to disengage from each other, followed by the first set of interlocking strip halves.

12. The container of claim 7, wherein pulling the first and third flaps causes the first set of interlocking strip halves to work against being pulled apart.

13. A container having a top end with an opening therein and a bottom end opposite the top end, and at least first and second sides between the top and bottom ends of the container, the container comprising:

a first layer of sheet material forming the first side of the container and at least a second and third layer of sheet material forming the second side of the container, a closure strip assembly extending along the opening of the container, the closure strip assembly comprising a male linear interlocking strip half and a female linear interlocking strip half, the male linear interlocking strip half having a barb extending therefrom and the female linear interlocking strip half having a hook shaped leg and a straight leg, the hook shaped leg is located upward from the straight leg, the barb and the hook shaped leg operable to engage each other in a sealed state and to release by rotating the female linear interlocking strip relative to the male linear interlocking strip to disengage the barb from the hook shaped leg, the closure strip assembly further comprising:

an extension above and an extension below a first of the linear interlocking strip halves, and an extension below a second of the linear interlocking strip halves, wherein the second layer of sheet material is attached to the closure strip assembly at the extension below the first linear interlocking strip half therewith forming a first upward extending flap, the first layer of sheet material is attached to the closure strip assembly at the extension below the second linear interlocking strip half therewith forming a second upward extending flap, and the third layer of sheet material is attached to the closure strip assembly at the extension above the first linear interlocking strip half therewith forming a third upward extending flap, wherein the second flap extends upward to form a lateral slit between the second and third layers of sheet material that does not provide access to the inside of the container, and wherein the container is therewith capable of being opened at the closure strip assembly by pulling the first and second flaps apart.

14. The container of claim 13, wherein pulling the first and second flaps causes a second set of interlocking strip halves to disengage from each other, followed by the linear interlocking strip halves.

15. A container having a top end with an opening therein and a bottom end opposite the top end, and at least first and second sides between the top and bottom ends of the container, the container comprising:

a first layer of sheet material forming the first side of the container and a first upward extending flap and at least a second and third layer of sheet material forming the second side of the container and second and third upward extending flaps, respectively, a closure strip assembly extending along the opening of the container, the closure strip assembly comprising a male linear interlocking strip half and a female linear interlocking strip half, wherein a first of the linear interlocking strip halves has the first upward extending flap attached thereto at an extension that extends from and below the first linear interlocking strip half, and the closure strip assembly has the second upward extending flap attached thereto at an extension that extends from and below a second of the linear interlocking strip halves, and the third upward extending flap attached thereto at an extension that extends from and above the first linear interlocking strip half, wherein the second flap extends upward to form a lateral slit between the second and third layers of sheet material that does not provide access to the inside of the container, and wherein the male and female linear interlocking strips are configured such that when engaged with each other pulling the first and second flaps apart cause the interlocking strips to be released from each other.

16. The container of claim 15, wherein the male linear interlocking strip has a barb extending therefrom and the female linear interlocking strip has a hook shaped leg, the barb and hook shaped leg operable to engage each other in a sealed state and releasable by rotating the female linear interlocking strip relative to the male linear interlocking strip to disengage the barb from the hook shaped leg.

17. The container of claim 16, wherein the female linear interlocking strip comprises a straight leg and wherein the hook shaped leg is located upward from the straight leg.

18. The container of claim 17, wherein the closure strip assembly comprises a second set of interlocking strips located below the linear interlocking strip halves.

19. The container of claim 18, wherein the second set of interlocking strips have a cross section that is symmetrical laterally.

* * * * *